US008275248B2

(12) United States Patent
Xu et al.

(10) Patent No.: US 8,275,248 B2
(45) Date of Patent: Sep. 25, 2012

(54) REPEATED EVAPORATION GARMENT STEAMER

(75) Inventors: Wanqun Xu, Zhejiang (CN); Qilin Li, Zhejiang (CN)

(73) Assignee: Wanqun Xu, Zhouxiang Town, Cixi, Zhejiang Province (CN)

( * ) Notice: Subject to any disclaimer, the term of this patent is extended or adjusted under 35 U.S.C. 154(b) by 781 days.

(21) Appl. No.: 12/479,781

(22) Filed: Jun. 6, 2009

(65) Prior Publication Data

US 2010/0166396 A1 Jul. 1, 2010

(30) Foreign Application Priority Data

Dec. 31, 2008 (CN) ..... 2008 1 0189819

(51) Int. Cl.
*A61H 33/06* (2006.01)
*A01G 13/06* (2006.01)

(52) U.S. Cl. ..... 392/394; 392/386

(58) Field of Classification Search ..... 392/386–406, 392/324–337; 237/78; 126/20–20.2; 4/524–535
See application file for complete search history.

(56) References Cited

U.S. PATENT DOCUMENTS 3,742,629 A * 7/1973 Plasko ..... 38/69
5,121,464 A * 6/1992 Hanada et al. ..... 392/405
5,123,266 A * 6/1992 Tabraham ..... 68/222
5,835,677 A * 11/1998 Li et al. ..... 392/401
5,835,678 A * 11/1998 Li et al. ..... 392/401
2006/0188239 A1* 8/2006 Carlucci ..... 392/403

* cited by examiner

*Primary Examiner* — Daniel L Robinson
(74) *Attorney, Agent, or Firm* — Global IP Services; Tianhua Gu

(57) ABSTRACT

This invention discloses a kind of garment steamer technology, which overcomes the defects of obvious condensation and return flow inside the steam duct and the low purity and temperature of steam. It comprises a main body, a steam duct and a brush head, being equipped with a water tank and a heating and vaporizing device inside, said heating and vaporizing device inside said main body comprising the first vaporizing device and the second vaporizing device, said brush head being equipped with the third vaporizing device; said first vaporizing device comprising a spiral vaporizing tube, an electric heating tube and a metal die cast; is provided with a water outlet pipe on the bottom, said water outlet pipe is connected with the water inlet of said spiral vaporizing tube via the pump. This product is featured by that the steam from said second vaporizing steam outlet has been provided with high purity and low humidity; after passing the third vaporizing device, the steam can be provided with guaranteed purity and temperature when being sprayed from the brush head, which greatly improves the ironing efficiency and effect of mites elimination and can be widely used in fashion stores, small clothing factories and some families with high requirements for dressing.

10 Claims, 9 Drawing Sheets

REPEATED EVAPORATION GARMENT STEAMER

CROSS REFERENCE TO RELATED PATENT APPLICATION

The present application claims the priority of the Chinese patent application No. 200810189891.1 filed on Dec. 31, 2008, which application is incorporated herein by reference.

FIELD OF THE INVENTION

This invention relates to a technology to produce a kind of garment steamer, and more specifically a technology for the evaporation device of a garment steamer.

BACKGROUND OF THE INVENTION

Unlike ordinary electric iron products, a garment steamer can be used for direct ironing on garments hanging on the rack, which ignored the trouble of ordinary iron that an ironing board is necessary. When ironing, the steam from the brush head passes though fibers of the ferment and eliminates crimples on the surface, making the garment natural and level; in the meanwhile, strange odors, bacteria and mites are also eliminated due to the high-temperature steam, therefore it is widely used in fashion shops, small clothing factories and some families with high requirements for dressing. At present, most garment steamers on the market are provided with a water tank and heating device inside the main body, water in the water tank flows automatically into the heating device due to the water head, while the heating device is actually an embedded open kettle, which only functions to boil the water to generate steam, due to its structure, an ordinary garment steamer cannot vaporize the steam produced as a steam iron does so as to supply the steam through the steam duct to the brush head for direct ironing; due to the condensation produced when the steam passes the steam duct, the steam coming out from the brush head is generally with high humidity, high temperature and low pressure, which lead to low ironing efficiency and insufficient effect of sterilization and mites elimination. The State Intellectual Property Office of the PRC has disclosed patent application number 200710079302.2 "Steam nozzle and garment steamer containing such nozzle" on Aug. 20, 2008, which added a heating device inside the steam nozzle on the steam panel to heat and vaporize the steam again before being sprayed from the steam nozzle, thus, the condensation water will not be brought out from the steam nozzle and the operation elevation of the steam duct is increased. However, applicant of this patent has found through researches that due to the heating device inside the product, the steam duct and the steam nozzle are connected to the atmosphere, although the steam is vaporized again before being sprayed from the nozzle, the steam generating device still adopts the structure of a kettle, thus, condensation is still unavoidable when the steam passes a long duct; Although the humidity of the steam is lowered, its temperature and pressure are also reduced, therefore, this product still fails to improve the low ironing efficiency and poor effect of mites elimination of most garment steamers.

SUMMARY OF THE INVENTION

This invention is to solve the obvious condensation phenomenon when the steam passes a long duct due to the aforesaid defects of existing products, which greatly reduces the outlet temperature and pressure of steam and leads to low ironing efficiency and poor effect of mites elimination, and to provide a garment steamer product adopting multiple evaporation, which can basically solve the problem of condensation and provides high temperature, high pressure and low humidity at the outlet of steam so as to truly improve the ironing efficiency and effect of mites elimination of products of the same and to meet the requirements of fashion stores, small clothing factories and some families to for direct ironing of hung garments, improve people's dressing standard and effectively extend the longevity of garment fibers.

The technical solution of this invention to solve the technical problems above is a kind of repeated evaporation garment steamer comprising: a standing main body, a vertical supporting pole, a flexible steam duct and a brush head mounted at the steam duct head, said main body being equipped with a water tank and a heating and vaporizing device inside, said garment steamer is featured by that said heating and vaporizing device inside said main body comprises the first vaporizing device and the second vaporizing device, said brush head is equipped with the third vaporizing device; said second vaporizing device moves forward with the repeated change in direction of steam flow generated by multiple stop boards; the first vaporizing device, the second vaporizing device and the third vaporizing device are mutually connected in order.

As an improvement, said first vaporizing device and said second vaporizing device use the same electric heating source to simplify the structure and reduce the cost.

As an improvement, said second vaporizing device forms multiple vaporizing chambers with several stop boards, said vaporizing chambers are arranged in a U shape or in the ring locally, which drives the steam flow to keep swinging forward while changing directions and forces the small liquid drops to be separated from the flow under the centrifugal force and the gravity and be thrown onto the wall of the vaporizing chamber or the bottom of the vaporizing chamber for re-heating and re-evaporation, and thus the steam can smoothly pass through the vaporizing chamber and the effect of reduced humidity, improved steam temperature and pressure can be achieved.

As a further improvement, said second vaporizing device comprises a concave cavity extending downwards from the surface of the die cast containing said steam chambers, said concave cavity is equipped with multiple stop boards, thus forming multiple vaporizing chambers, every steam guiding opening is provided at the top of the diagonal between 2 neighboring stop boards; said die cast surface is connected with a cover plate, the second vaporizing steam inlet and the second vaporizing steam outlet are provided on said cover plate; said second vaporizing steam inlet and said second vaporizing outlet are respectively connected to the vaporizing chambers on both ends inside said concave cavity.

Said first vaporizing device comprises a spiral vaporizing tube and a spiral electric heating tube as well as a metal die cast integrating said vaporizing tube and said electric heating tube for heat conduction; the steam outlet of said spiral vaporizing tube is connected with the steam inlet of said second vaporizing device, the steam outlet of said second vaporizing device is connected with said third vaporizing device inside said brush head via said steam duct; Said water tank is provided with a water outlet pipe on the bottom, said water outlet pipe is connected with the water inlet of said spiral vaporizing tube via the pump.

Said die cast is made of aluminum, zinc or copper or alloy of them.

Said third vaporizing device is provided on the front of said brush head, comprising a long waist-shaped vaporizer with a cast electric heating tube, said vaporizer is equipped with multiple steam nozzles on the face for spraying and a long waist-shaped sunk seat on the other face; a baffle liner is provided inside said sunk seat, the height of said baffle liner is basically the same to the depth of said sunk seat; one end of said baffle liner is closely connected with the wall of said sunk seat, the other end of said baffle liner is located inside said sunk seat without being connected with the wall of said sunk seat, thus forming an opening; said multiple steam nozzles are located on the inside said baffle liner; a vaporizing cover is fixed on the surface of said long waist-shaped sunk seat, said vaporizing cover is provided with a third vaporizing steam inlet, said third vaporizing steam inlet connected with one end of said baffle liner closely connected with said sunk seat.

Said vaporizer is made of aluminum, zinc or copper or alloy of them.

Said main body is provided with the steam flow adjustment device, said steam flow adjustment device comprises a sliding-arm resistor serially connected with said pump and a thermistor connected with said sliding-arm resistor in parallel connection.

Said water tank is provided with a sediment evacuation device on the bottom.

The heating and vaporizing device inside the main body of the product according to this invention comprises the first vaporizing device and the second vaporizing device, both vaporizing devices adopt the same heating source; the third vaporizing device is provided in said brush head. The liquid water is pumped by said water pump and pass along said spiral vaporizing tube of said first vaporizing device, during the process, with its temperature ascending gradually, the liquid water is gradually vaporized till fully vaporized at the steam outlet of said spiral vaporizing tube.

When the steam with high humidity carrying a few small liquid drops enters the vaporizing chamber at the side of the second vaporizing device with said concave cavity, it can only goes forwards by swinging along the steam guiding opening on the top of said stop boards, due to the double effect of the centrifugal force and gravity, small liquid drops mixed in the steam will either be thrown onto walls of said vaporizing chamber or drop down to the bottom of said vaporizing chamber for the second vaporization and then goes towards the third vaporizing steam inlet along with the steam. Due to the effect of the second vaporizing device, steam exported from said second vaporizing steam outlet has been provided with high purity, low humidity and the temperature as high as 180~220° C.

After entering said third vaporizing steam inlet, the steam from said steam duct will rotate anticlockwise under the guiding effect of said baffle liner and then go directly leftwards, and then enter said baffle liner after another rotation anticlockwise, and finally, it will be sprayed from multiple steam nozzles. During the course of rotation, the steam is heated by said vaporizer and its temperature will rise to 170~190° C. as set by said temperature controller, which prevents the purity and temperature of steam sprayed from said multiple steam nozzles from declining.

Said main body is provided with a steam flow adjustment device containing said sliding-arm resistor, a thermistor is connected to said sliding-arm resistor in parallel connection. During long-term continuous operation of the water pump, the temperature of said thermistor will rise to increase the impedance, leading to synchronous increase of the parallel impedance of said sliding-arm resistor and said thermistor, thus the pressure reduction increases, voltage and power at both ends of said water pump will also reduce, therefore the liquid water pumped from said water tank to filled into said spiral vaporizing tube reduces, which lead to reduction of steam flow sprayed, and thus effectively ensures this product to work continuously for a long time without reduction of purity and temperature of steam sprayed from said brush head.

Compared with existing kettle type garment steamers, this product effectively overcomes the defect of obvious condensation and return flow inside the steam duct, effectively ensures the purity and temperature of steam sprayed from said brush head, greatly improves the ironing efficiency and the effect of sterilization and mites elimination, moreover, it has the advantages of novel concept, rational structure, low energy consumption and high reliability and can meet the requirements of fashion stores, small clothing factories and some families with high requirements for dressing.

DETAIL DESCRIPTION OF THE INVENTION

Figure 1:
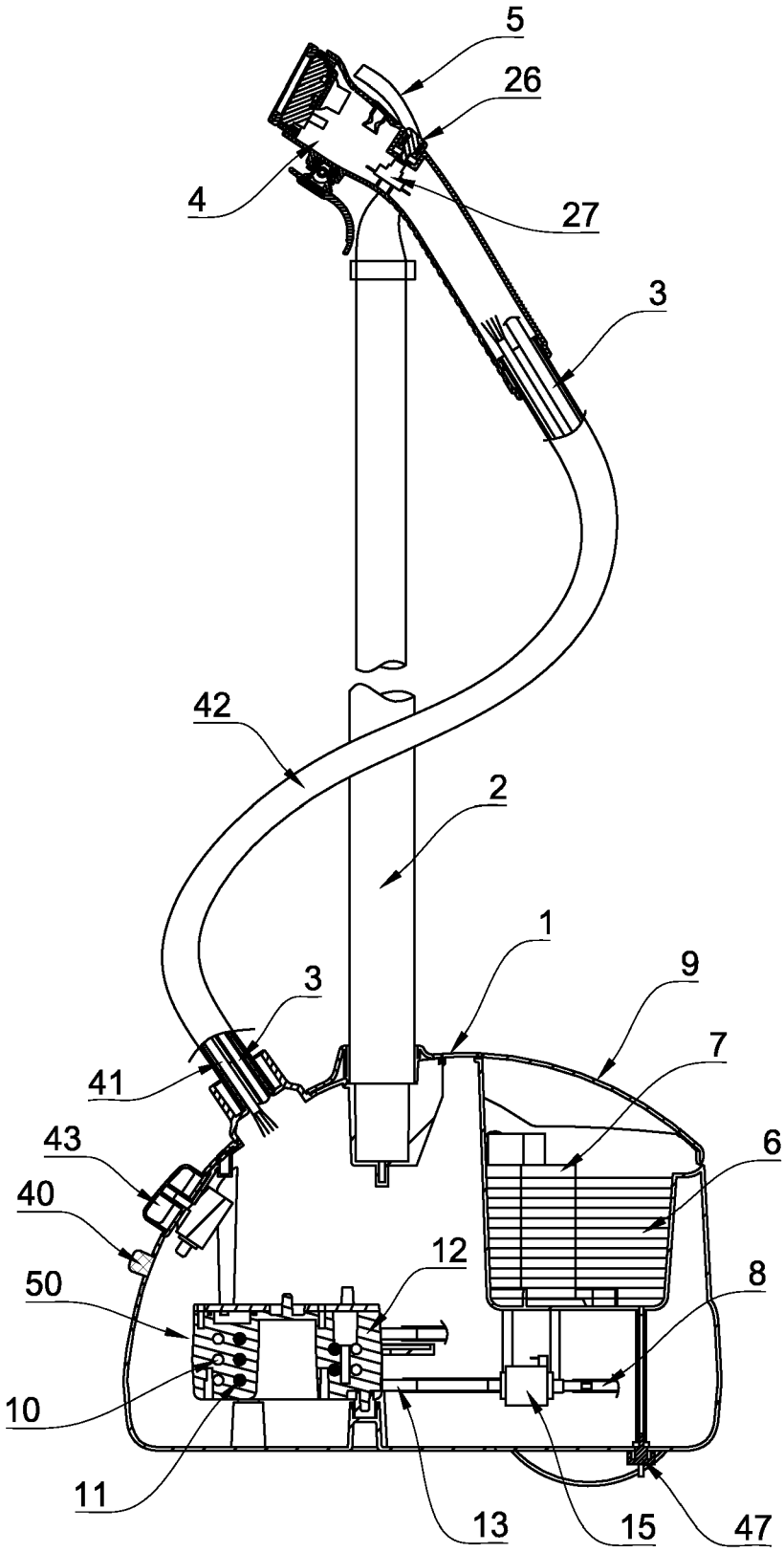
FIG. 1 is an overall structural diagram of this invention.

As shown in FIG. 1, this invention comprises a standing movable main body 1, a vertical supporting pole 2, a flexible steam duct 3 and a brush head 4 mounted on the head of said steam duct, a block fork 5 is provided on top of said supporting rod 2 for placing said brush head 4; the steam duct 3 and the control cables 41 of the brush head 4 are enclose by the protective hose 42. Said main body 1 is provided with a water tank 6 and a heating and vaporizing device 50, said water tank 6 is provided with the filter device 7, which is provided with the water outlet pipe 8 and the evacuation device 47; corresponding to the opening of said water tank 6, said main body is provided with the water tank cover 9. The heating and vaporizing device 50 inside said main body 1 comprises the first vaporizing device and the second vaporizing device, said first vaporizing device adopting the patented utility model technology named "Real-time steam supply steam generator for electric irons", for which the applicant of this patent obtained the patent grant publication No. ZL200620104985.3 from the State Intellectual Property Office of the PRC on Jun. 20, 2007 comprises a spiral vaporizing tube 10 and a spiral electric heating tube 11 as well as a metal die cast 12 integrating said vaporizing tube and said electric heating tube for heat conduction; said die cast 12 may be made of aluminum, zinc or copper or alloy of them. Considering the material cost, processing plasticity and thermal conductivity, etc., aluminum die cast is mainly adopted in actual applications. One end of said spiral vaporizing tube 10 is the water inlet 13, the other end is the steam outlet 14; the water outlet pipe 8 on the bottom of the filter device 7 inside said water tank 6 is connected with the water inlet 13 of said spiral vaporizing tube via the water pump 15. The power supply 43 and the steam flow adjustment device 40 are provided on the case of said main body 1.

Figure 2:
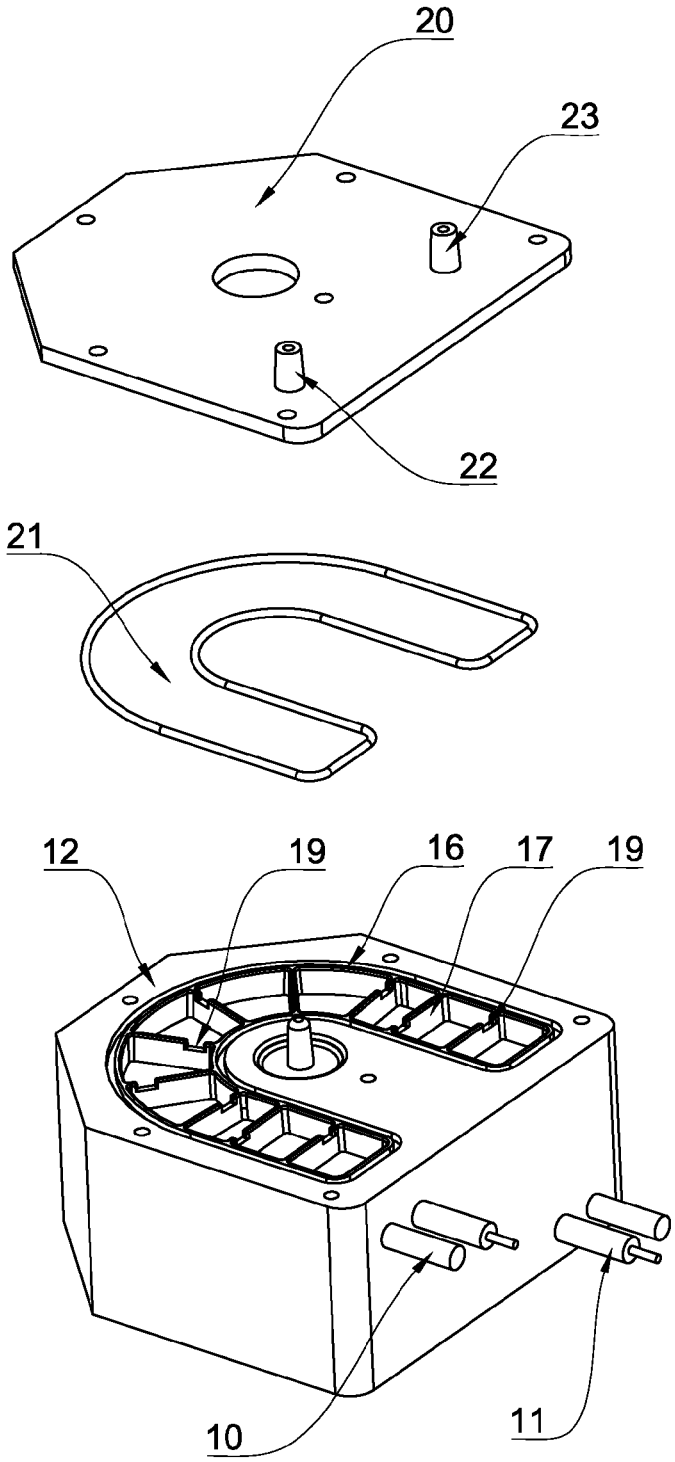
FIG. 2 is the 3D exploded view of the die cast of the heating and vaporizing device inside the main body of this invention.
Figure 3:
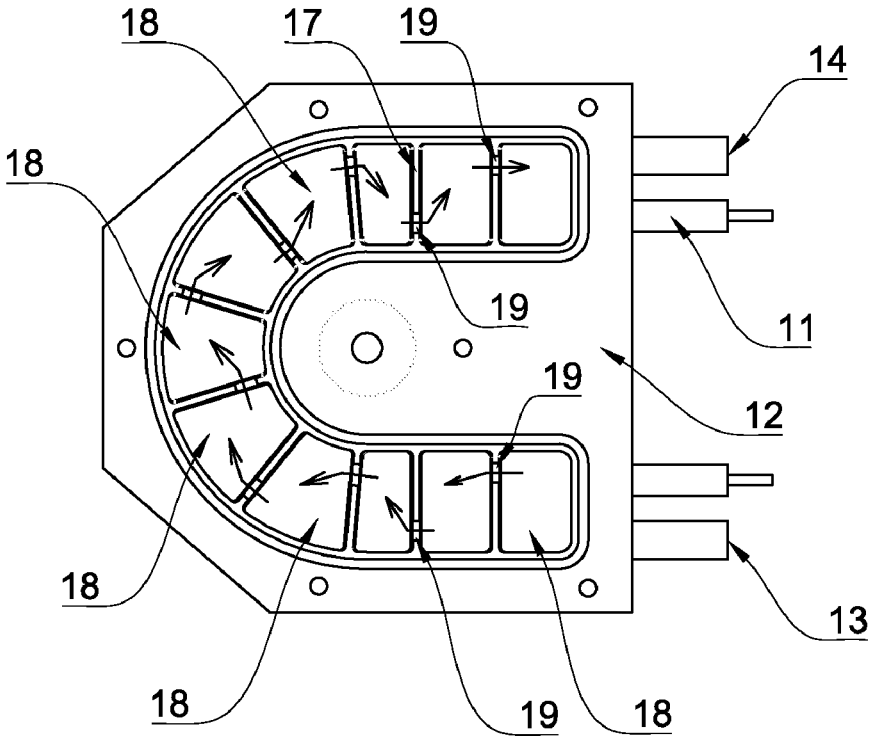
FIG. 3 is the top view of the heating and vaporizing device inside the main body of this invention.

As shown in FIG. 2 and FIG. 3, said second vaporizing device is equipped on the top of said die cast 12 and use the same electric heating supply with the first vaporizing device, it comprises a concave cavity 16 extending downwards from the surface of the die cast, said concave cavity 16 is provided with 10 stop boards 17 axially, thus forming 11 vaporizing chambers 18, said vaporizing chambers 18 are connected in order and arranged generally in a U shape, every steam guiding opening 19 is provided at the top of the diagonal between 2 neighboring stop boards 17; said die cast 12 surface is connected with a coverplate 20, sealing gaskets 21 are provided between said die cast 12 and said cover plate 20; the second vaporizing steam inlet 22 and the second vaporizing steam outlet 23 are provided on said cover plate 20, said second vaporizing steam inlet 22 and said second vaporizing outlet 23 are respectively connected to the vaporizing chambers 18 on both ends inside said concave cavity 16. To facilitate processing, the concave cavity 16 in this embodiment adopts U-shaped longitudinal section. Said second vaporizing steam inlet 22 is connected to the steam outlet 14 of said spiral vaporizing tube via a hose (not shown in the drawings); The steam outlet 23 of said second vaporizing is connected to the connector (not shown in the drawings) of said steam duct 3 inside said main body 1 via a hose (not shown in the drawings). Said stop boards 17 may be in other shapes, labyrinth, for instance, to allow parallel staggered payout of flow baffling, since this is common for traditional heat exchangers, no deep description is given here.

Figure 4:
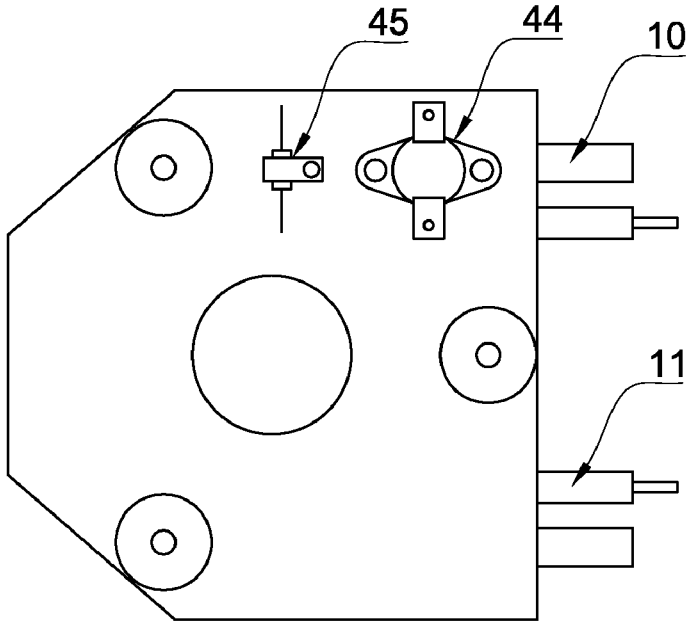
FIG. 4 is the bottom view of the heating and vaporizing device inside the main body of this invention.

As shown in FIG. 4, said die cast 12 is provided with a temperature controller 44 and a thermal cutout 45, both said temperature controller 44 and said thermal cutout 45 adopt existing technologies and are serially connected with the circuit of said spiral electric heating tube 11 and said die cast 12.

Figure 5:
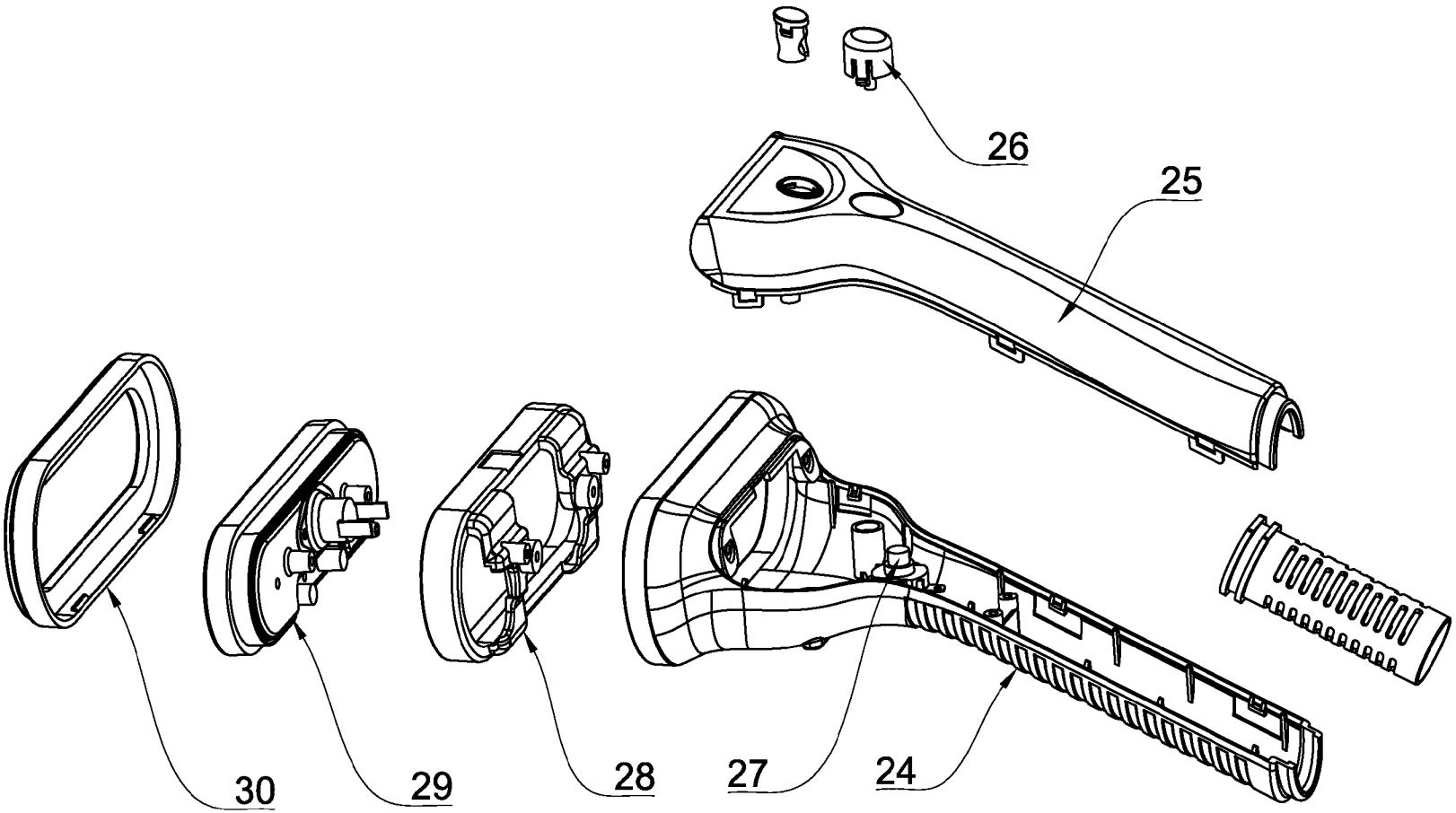
FIG. 5 is the 3D exploded view of the brush head of this invention.
Figure 6:
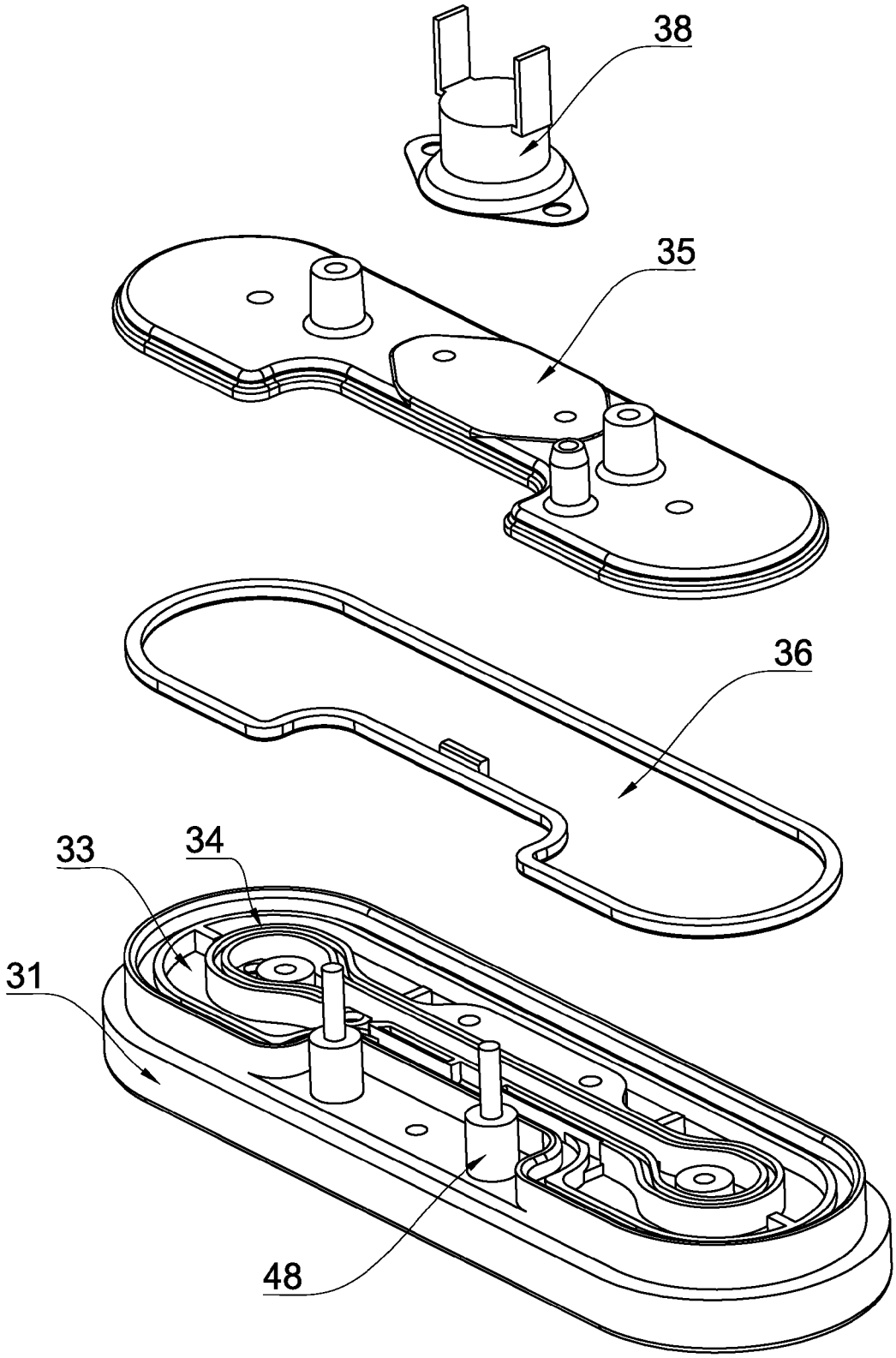
FIG. 6 is the 3D exploded view of the third vaporizing device inside the brush head of this invention.
Figure 7:
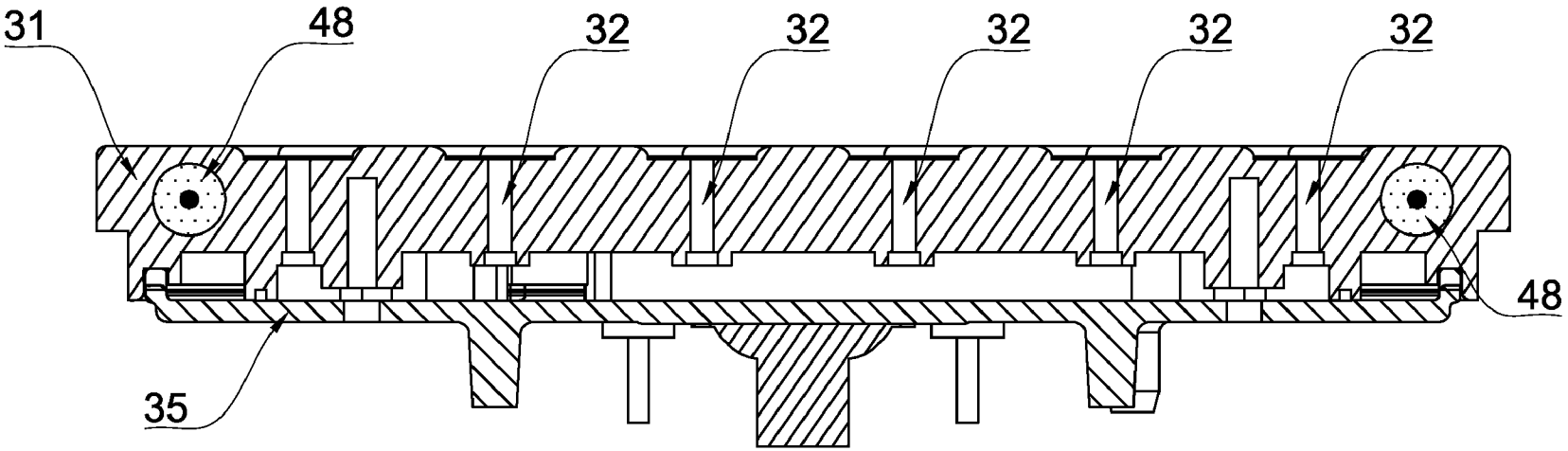
FIG. 7 is the sectional view of the third vaporizing device inside the brush head of this invention.

As shown in FIG. 5, said brush head 4 comprises a handle 24 and a shield 25 with a switch 26 mounted on the upper half of said handle 24, a control switch 27 for water pump 15 is provided in the handle 24 below said switch 26; said brush head 4 is provided with a heat insulating rack 28, the third vaporizing device 29 and a protective cover 30 in order on the front face.

As shown in FIGS. 6 to 9, said third vaporizing device 29 comprises a long waist-shaped vaporizer 31 with cast electric heating tube 48, said vaporizer 31 is made of aluminum, zinc or copper or alloy of them; said vaporizer 31 is equipped with 6 steam nozzles 32 on the face for spraying (the number of nozzles 32 may be adjusted according to the power) and a long waist-shaped sunk seat on the other face; a baffle liner 34 is provided inside said sunk seat 33, the height of said baffle liner 34 is basically the same to the depth of said sunk seat 33; one end of said baffle liner 34 is closely connected with the wall of said sunk seat 33, the other end of said baffle liner 34 is located inside said sunk seat 33 without being connected with the wall of said sunk seat 33, thus forming an opening; said 6 steam nozzles 32 are located on the inside said baffle liner 34; a vaporizing cover 35 is fixed on the surface of said long waist-shaped sunk seat 33, said vaporizing cover 35 is provided with a third vaporizing steam inlet 37, said third vaporizing steam inlet 37 is connected with one end of said baffle liner 34 closely connected with said sunk seat 33.

Figure 8:
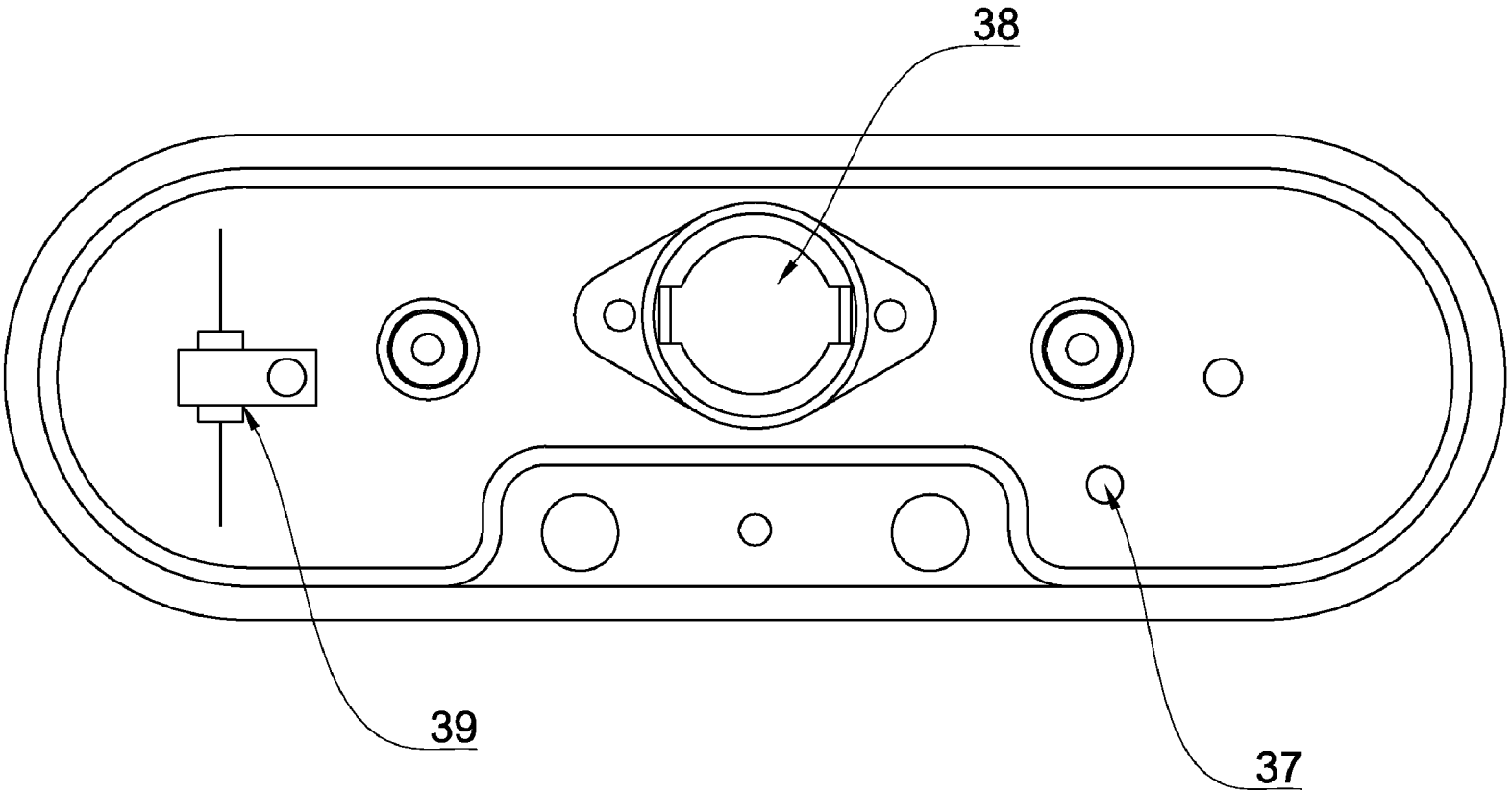
FIG. 8 is a bottom view of FIG. 7.

As shown in FIG. 8, said vaporizing cover 35 is equipped with a temperature controller 38 and a thermal cutout 39, both said temperature controller 38 and said thermal cutout 39 adopts existing technologies and are serially connected with the circuit of the electric heating tube 48 inside said long waist-shaped vaporizer 31.

Figure 10:
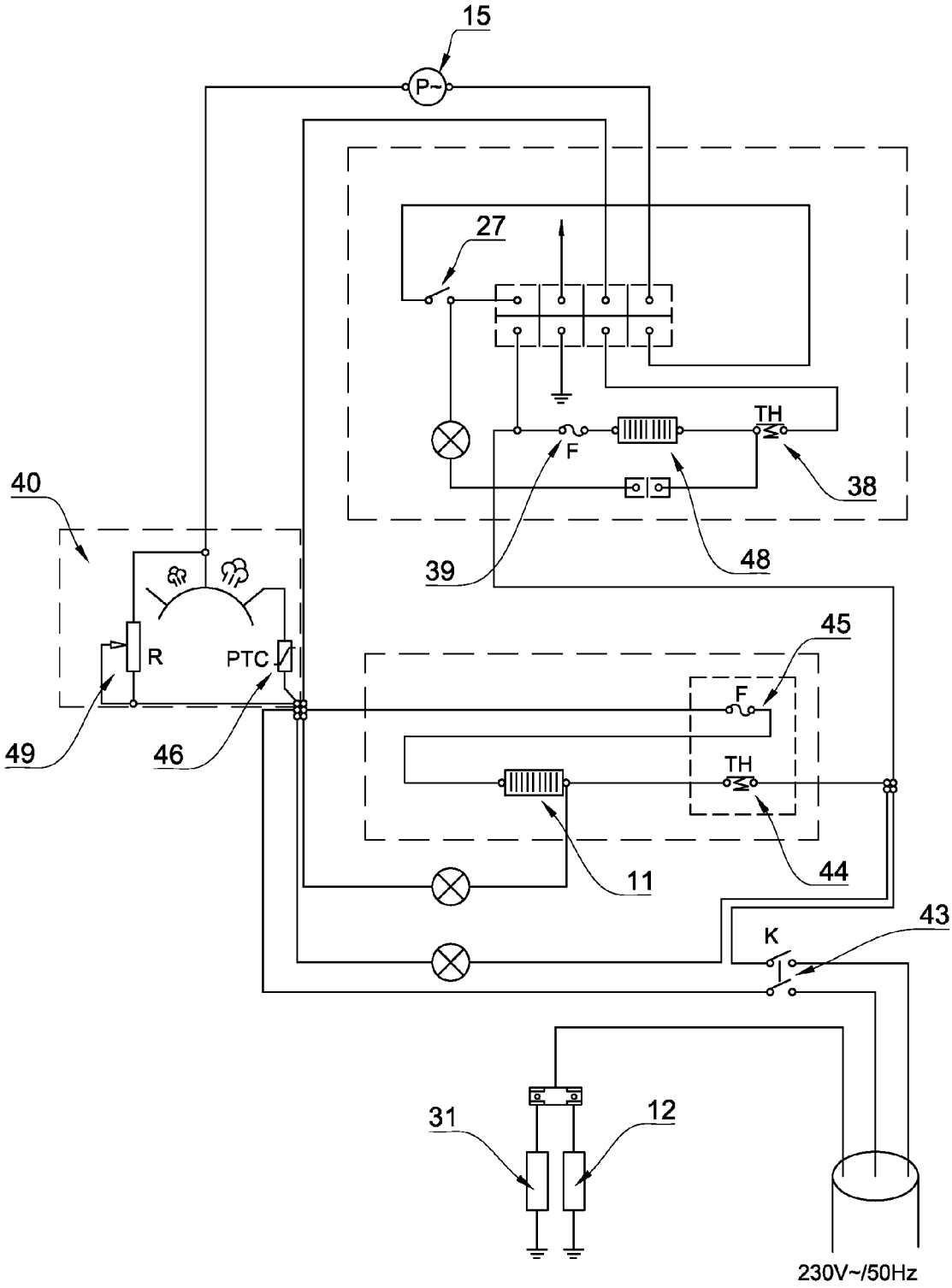
FIG. 10 is the electrical diagram of this invention.

As shown in FIG. 10, the power switch 43 on the case of said main body 1 is the master switch to be connected with the external power supply, spiral electric heating tube 11 of the die cast 12 is serially connected with the temperature controller 44 and thermal cutout 45 of the die cast 12, the preset temperature of the temperature controller 44 is 180~220° C. The electric heating tube 48 inside the long waist-shaped vaporizer 31 is serially connected with the temperature controller 38 and the thermal cutout 39 of the long waist-shaped vaporizer 31, the preset temperature of the temperature controller 38 is 170~190° C. Said steam flow adjustment device 40 comprises a sliding-arm resistor 49 serially connected with said water pump 15, said sliding-arm resistor 49 is connected with a thermistor 46 in parallel. The control switch 27 of said water pump is serially connected with the circuit of said water pump. Said long waist-shaped vaporizer 31 and the case of said die cast 12 are provided with grounded protection.

Now let's briefly describe the working principle of this invention in combination with the drawings. In normal state, in said main body 1 of this invention, there's no liquid water in the heating and vaporizing device 50 comprising the first vaporizing device and the second vaporizing device. When using, turn on said power switch 43 to connect the external power supply, the spiral electric heating tube 11 inside said die cast 12 and the electric heating tube 48 inside said long waist-shaped vaporizer 31 will give out heat for temperature rise, when the temperature rises to 180~220° C. as set by said temperature controller 44 and 170~190° C. as set by said temperature controller 38, the product is in working status. At this time, if you press said switch 26 to trigger the water pump control switch 27 below to connect said water pump 15 circuit, then the water pump 15 will pump water from said water tank 6 and fill the water into the water inlet 13 of said spiral vaporizing tube 10, under the pumping pressure of the water pump 15, the liquid water will go forward spirally along said spiral vaporizing tube 10, during the journey, it is gradually vaporized till fully vaporized at the steam outlet 14 of said spiral vaporizing tube 10; then the steam enters the vaporizing chamber 18 inside the concave cavity 16 via the hose from the second vaporizing steam inlet 22 of the cover plate 20, and then the steam entering said vaporizing chamber 18 is sprayed due to the pumping pressure of said water pump 15, therefore, it is with high humidity and carries a few small liquid drops.

As shown in FIG. 3, the steam entering the vaporizing chamber 18 can only cross along the steam guiding opening 19 on the upper end of said stop boards 17, and because the steam guiding opening 19 between 2 neighboring stop boards 17 is provided at the top of the diagonal between the both, the steam can only goes forwards by swinging along the direction indicated by the arrow in FIG. 3; due to the double effect of the centrifugal force and gravity, the small liquid drops mixed in the steam will either be thrown onto walls of said vaporizing chambers 18 or drop down to the bottom of said vaporizing chambers 18, thus the steam can smoothly cross the whole concave cavity 16 and then flow from said second vaporizing steam outlet 23 to the lower connector of the steam duct 3 inside said main body via the hose, and to the third vaporizing steam inlet 37 inside said brush head vaporizing cover 35 via the steam duct 3. Liquid drops thrown onto the walls of said vaporizing chambers 18 or dropping down to the bottom of said vaporizing chambers 18 are vaporized due to the heating of the said die cast 12 and then goes towards the third vaporizing steam inlet 37 along with the steam. Due to the effect of the second vaporizing device, steam exported from said second vaporizing steam outlet has been provided with high purity, low humidity and the temperature as high as 180~220° C.

Figure 9:
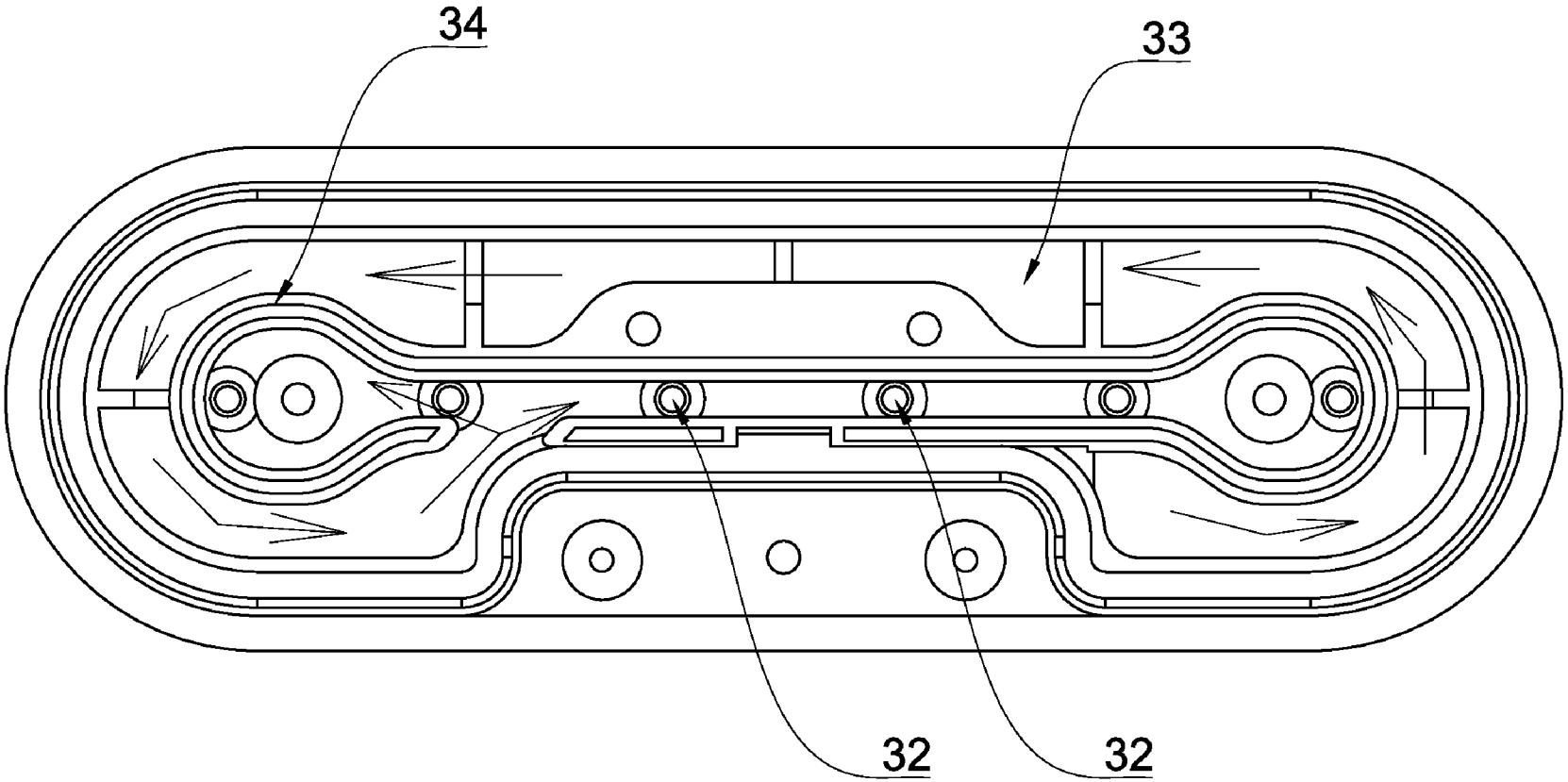
FIG. 9 is the structural diagram of the long waist-shaped vaporizer in the third vaporizing device of this invention.

As shown in FIG. 9, the steam from said second vaporizing steam outlet 23 goes from said third vaporizing steam inlet 37 via the steam duct 3 into the lower right sunk seat part on the side of said baffle liner 34 closely connected with said sunk seat 33, as indicated by the arrow in FIG. 9, it will then rotate anticlockwise under the guiding effect of said baffle liner 34 and then go directly leftwards, and then enter said baffle liner 34 after another rotation anticlockwise, and finally, it will be sprayed from the 6 steam nozzles. During the course of rotation, the steam is heated by said vaporizer 31 while passing the long steam duct 3 and its temperature will rise to 170~190° C. as set by said temperature controller, which prevents the purity and temperature of steam sprayed from said 6 steam nozzles 32 from declining.

As shown in FIGS. 1 and 10, if the volume of steam spray is to be adjusted, just slide the steam flow adjustment device 40 on the case of said main body 1, the impedance of the sliding-arm resistor 49 in the circuit will change, after voltage reduction by the sliding-arm resistor 49, the voltage supplied to said water pump 15 will change, which will cause change in the power of said water pump 15, the liquid water pumped by said water tank 6 and filled into said spiral vaporizing tube 10 will then change, which will finally cause change in the steam volume produced, and thus the adjustment of the volume of steam spray is achieved. To avoid pressing and holding said switch 26 for a long time, which will cause long-term continuous water supply by the water pump and result in declined temperature and increased humidity of the steam sprayed from the brush head 4, a thermistor 46 is connected to said sliding-arm resistor 49 in parallel; if the circuit of the water pump works continuously for a long time, the thermistor 46 will raise the temperature to increase the impedance, leading to synchronous increase of the parallel impedance of said sliding-arm resistor 49 and said thermistors 46, thus the pressure reduction increases, voltage and power at both ends of said water pump 15 will also reduce, therefore the liquid water pumped from said water tank 6 to filled into said spiral vaporizing tube 10 reduces, which lead to reduction of steam flow sprayed, and thus effectively ensures this product to work continuously for a long time without reduction of purity and temperature of steam sprayed from said brush head 4.

What is claimed is:

1. A repeated evaporation garment steamer comprising:

a standing main body (1), a vertical supporting pole (2), a flexible steam duct (3) and a brush head (4) mounted at the steam duct head, said main body (1) being equipped with a water tank (6) and a heating and vaporizing device (50) inside, wherein:

the heating and vaporizing device (50) inside said main body (1) comprises a first vaporizing device and a second vaporizing device;

said brush head (4) is provided with a third vaporizing device (29);

said second vaporizing device has multiple stop boards for repeatedly changing the direction of steam flow;

said first vaporizing device, second vaporizing device and third vaporizing device (29) are mutually connected in order.

2. A repeated evaporation garment steamer according to claim 1, wherein said first vaporizing device and said second vaporizing device use a same electric heating source.

3. A repeated evaporation garment steamer according to claim 2, wherein said second vaporizing device has multiple vaporizing chambers (18) established by the multiple stop boards (17), said vaporizing chambers (18) are arranged in a U shape or in a partial ring shape.

4. A repeated evaporation garment steamer according to claim 3, wherein said second vaporizing device comprises a concave cavity (16) equipped with multiple stop boards (17) to form multiple vaporizing chambers (18), a steam guiding opening (19) is provided at the left or right side of the top of each of the stop boards (17), one is at left, other is at right alternatively; said die cast (12) surface is covered with a cover plate (20), the second vaporizing steam inlet (22) and the second vaporizing steam outlet (23) are provided in said cover plate; said second vaporizing steam inlet (22) and said second vaporizing outlet (23) are respectively connected to the first and last one of vaporizing chambers (18) inside said concave cavity (16).

5. A repeated evaporation garment steamer according to claim 4, wherein said first vaporizing device comprises a spiral vaporizing tube (10) and a spiral electric heating tube (11) as well as a metal die cast (12) which integrates said vaporizing tube (10) and said electric heating tube (11) for heat conduction; the steam outlet (14) of said spiral vaporizing tube is connected with the steam inlet (22) of said second vaporizing device, the steam outlet (23) of said second vaporizing device is connected with said third vaporizing device (29) inside said brush head (4) via said steam duct (3); said water tank (6) is provided with a water outlet pipe (8) on the bottom, said water outlet pipe is connected with the water inlet (13) of said spiral vaporizing tube via the pump (15).

6. A repeated evaporation garment steamer according to claim 5, wherein said die cast (12) is made of aluminum, zinc or copper or alloy of them.

7. A repeated evaporation garment steamer according to claim 1, wherein said third vaporizing device (29) provided on the front of said brush head (4), comprises a vaporizer (31) with an electric heating tube (48), said vaporizer (31) is equipped with multiple steam nozzles (32) on a spraying face and a sunk seat (33) on other face; a baffle liner (34) is provided inside said sunk seat (33), the height of said baffle liner (34) is basically the same to the depth of said sunk seat (33); one end of said baffle liner (34) is closely connected with the wall of said sunk seat (33), the other end of said baffle liner is located inside said sunk seat (33) without being connected with the wall of said sunk seat (33), thus forming an opening; said multiple steam nozzles (32) are located on the inside said baffle liner (34); a vaporizing cover (35) is fixed on the surface of said sunk seat (33), said vaporizing cover (35) is provided with a third vaporizing steam inlet (37), which is connected with the multiple steam nozzles (32) via a passage defined by the baffle liner (34).

8. A repeated evaporation garment steamer according to claim 7, wherein said third vaporizer is made of aluminum, zinc or copper or alloy of them.

9. A repeated evaporation garment steamer according to claim 1, wherein said main body (1) is provided with a steam flow adjustment device (40), said steam flow adjustment device (40) comprises a sliding-arm resistor (49) serially connected with a pump (15) and a thermistor (46) connected with said sliding-arm resistor (49) in parallel connection.

10. A repeated evaporation garment steamer according to claim 1, wherein said water tank (6) is provided with a sediment evacuation device (47) on the bottom.

* * * * *